US007261215B2

(12) United States Patent
Moss et al.

(10) Patent No.: US 7,261,215 B2
(45) **Date of Patent: *Aug. 28, 2007**

(54) FOLDABLE STEPPED DISPLAY STAND HAVING SHELVES WITH OPEN SIDES

(75) Inventors: Geoffrey Alan Moss, Maple (CA); David Brian Minister, Toronto (CA)

(73) Assignee: PopTech Ltd, Toronto, Ontario (CA)

( * ) Notice: Subject to any disclaimer, the term of this patent is extended or adjusted under 35 U.S.C. 154(b) by 418 days.

This patent is subject to a terminal disclaimer.

(21) Appl. No.: 10/967,685

(22) Filed: Oct. 18, 2004

(65) Prior Publication Data

US 2005/0051504 A1 Mar. 10, 2005

Related U.S. Application Data

(62) Division of application No. 10/458,834, filed on Jun. 12, 2003, now Pat. No. 6,871,750.

(51) Int. Cl.
*A47F 5/08* (2006.01)

(52) U.S. Cl. ..... 211/149; 211/73; 211/195

(58) Field of Classification Search ..... 211/149, 211/72, 73, 195, 132.1, 126.16; 297/440.12; 108/108, 100, 135; 248/174, 154, 152, 300; 206/45.24, 740, 756, 767

See application file for complete search history.

(56) References Cited

U.S. PATENT DOCUMENTS 1,720,136 A * 7/1929 Neumann ..... 108/100
1,747,981 A * 2/1930 Marsh ..... 108/100
1,902,566 A * 3/1933 Marsh ..... 211/72
1,925,673 A * 9/1933 Potter ..... 108/100
1,947,195 A * 2/1934 Flynn ..... 108/100
2,324,232 A * 7/1943 Pantalone ..... 211/73
3,438,508 A * 4/1969 Kuns et al. ..... 211/126.16
3,606,459 A * 9/1971 Krone ..... 297/440.12
4,811,987 A * 3/1989 Volpe et al. ..... 297/440.12
4,991,804 A * 2/1991 Iannucci ..... 248/174
6,871,750 B2 * 3/2005 Moss et al. ..... 211/149

* cited by examiner

*Primary Examiner*—Jennifer E. Novosad
(74) *Attorney, Agent, or Firm*—David W. Wong

(57) ABSTRACT

A foldable display stand having three opened side shelves is formed by two stepped side panels, a front panel, and a rear panel which are formed from a single geometrical figure formed in a single sheet material. The stand is foldable into a collapsed condition relative to two vertical fold lines formed on the side panel and located opposite to one another. The front panel will abut the rear panel when the stand is folded in the collapsed condition. The shelves are formed by a plurality of panels formed in an upper extension to the front panel and the rear panel. These panels are foldable relative to horizontal fold lines to form the three shelves resting horizontally on stepped upper edges of the side panels. Open end slots are formed in a free end edge of end panels of the front panel and rear panel, which are engageable with upper edges of the side panels for latching the opened side shelves securely in the horizontal position.

10 Claims, 8 Drawing Sheets

FOLDABLE STEPPED DISPLAY STAND HAVING SHELVES WITH OPEN SIDES

This application is a divisional application of U.S. patent application Ser. No. 10/458,834 filed 12 Jun. 2003 now U.S. Pat. No. 6,871,750 by the same inventors of this application.

FIELD OF THE INVENTION

This invention relates to display stands, and more particularly to a stepped display stand having shelves with open sides and is constructed from a single sheet material such as card board or corrugated board.

BACKGROUND OF THE INVENTION

Display stands made of card board material are convenient and economical to use. Commonly, display stands have an upright structure with two parallel side walls to define a three sided vertical space in which a plurality of shelves are provided. A main drawback of such display stands is that the side walls would block the view of the display articles from the two sides. Furthermore, such stands consist of many components parts which the user must assembled together in use. Due to the plurality of components, they are often time consuming and frustrating to assemble. Attempts have been made to provide display stands made from a single sheet material which may be folded along various score lines to form the final stand having a plurality of shelves. A multi-shelf display stand of such type is shown in U.S. Pat. No. 4,311,100 to J. M. Gardner et al. However, such stand has side walls which block the view of the displayed items on the shelves from the sides, and it is awkward and difficult to set up, and it may not be folded into a collapsed condition to facilitate transportation and storage.

SUMMARY OF THE INVENTION

It is a principal object of the present invention to provide a stepped display stand which has open shelves such that the display articles are visible from the sides and even at certain angles from the rear.

It is another object of the present invention to provide a stepped display stand made from a single sheet material.

It is another object of the present invention to provide a foldable stepped display stand which is collapsible into a folded condition for easy transportation and storage.

It is still another object of the present invention to provide a stepped display stand which may be set up or folded easily and quickly.

BRIEF DESCRIPTION OF THE DRAWINGS

The above objects and novel features of the present invention will be more clearly and fully set forth in the following specification with reference to the accompanying drawings in which.

DETAILED DESCRIPTION OF THE PREFERRED EMBODIMENTS

Figure 1:
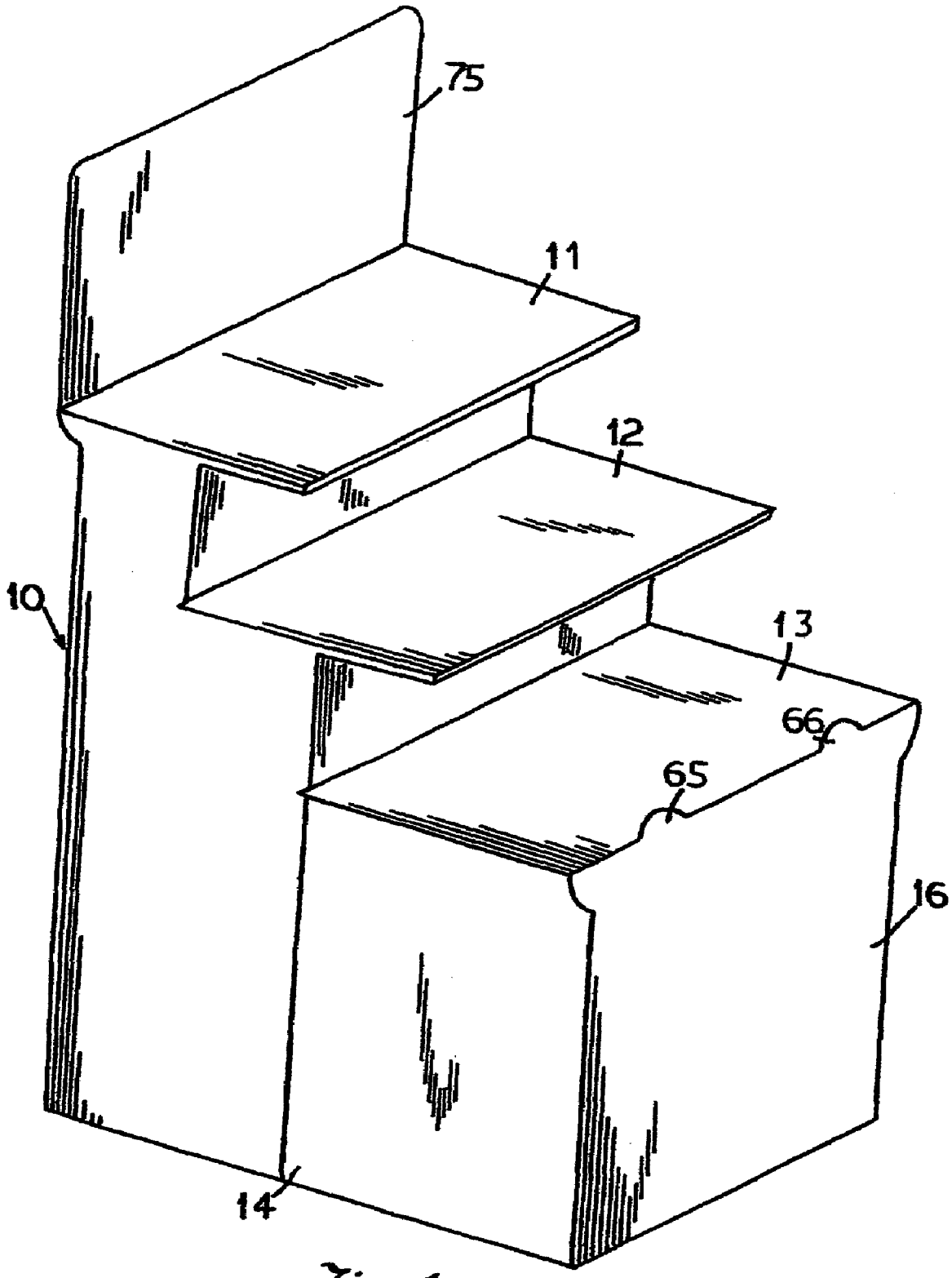
FIG. 1 is a general perspective side elevation view of the stepped display stand according to the present invention.

With reference to the drawings in which like reference numerals designate corresponding parts in the various views, the display stand 10 of the present invention has three open shelves 11, 12 and 13. Three shelves are shown as an example for simplicity in illustration. A plurality of shelves may be provided according to the invention.

The display stand 10 has two stepwise side panels 14 and 15 which are mirror images of one another, a front panel 16, and a rear panel 17. The left side panel 14 has a horizontal lower top edge 18, a horizontal middle top edge 19, and an horizontal upper top edge 20. Similarly, the right side panel 15 has a horizontal lower top edge 21 which is at the same height as the left lower top edge 18, a horizontal middle top edge 22 which is at the same height as the left middle top edge 19, and a horizontal upper top edge 23 which is at the same height as the left upper top edge 20.

The rear panel 17 is a generally rectangular panel having the same height as the top edges of the two side panels 14 and 15. A generally rectangular upper extension 24 extends upwards from the upper edge 25 of the rear panel 17. The upper extension 24 is wider than the rear panel 17 and it is foldable relative to the rear panel 17 along the upper edge 25, and it consists of a first section 26, a second section 27, a third section 28 and an upper end section 29. The second section 27 is foldable relative to the first section 26 along horizontal fold line. The third section 28 is foldable relative to the second section 27 along horizontal fold line 31, and the upper end section 29 is foldable relative to the third section 28 along horizontal fold line 32. Two vertical open end slots 33 and 34 are formed at the upper edge 35 of the upper end section 29. The distance between the open end slots 33 and 34 is equal to the width of the rear panel 17.

The front panel 16 is a rectangular panel equal in width to the rear panel 17, and it has a wider upper extension portion 36 which consists of a first section 37, a second section 38, a third section 39, a fourth section 40, a fifth section 41, and an upper free end sixth section 42. The height of the first section 37 is equal to the length of the lower top edge 18 and 21 of the side panels 14 and 15 respectively. The height of the third section 39 is equal to the height between the lower top edge 18 to the middle top edge 19 and between the lower top edge 21 to middle top edge 22 of the side panels 14 and 15 respectively. The first section 37 is foldable relative to the front panel 16 along horizontal fold line 43. The second section 38 is foldable relative to the first section 37 along horizontal fold line 44. The third section 39 is foldable relative to the second section 38 along horizontal fold line 45. The fourth section 40 is foldable relative to the third section 39 along horizontal fold line 46. The fifth section 41 is foldable relative to the fourth section 40 along horizontal fold line 47, and the upper free end sixth section 42 is foldable relative to the fifth section 41 along horizontal fold line 48. Two vertical slots 49A and 50A are formed at the horizontal line 45 between the third section 38 and the fourth section 39. The distance between the vertical slots 49A and 50A is equal to the width of the front panel 16, also two open end slots 49B and 50B are formed at the upper edge of the upper free end section 42. The distance between the open end slots 49 and 50 is equal to the width of the front panel 16.

Figure 2:
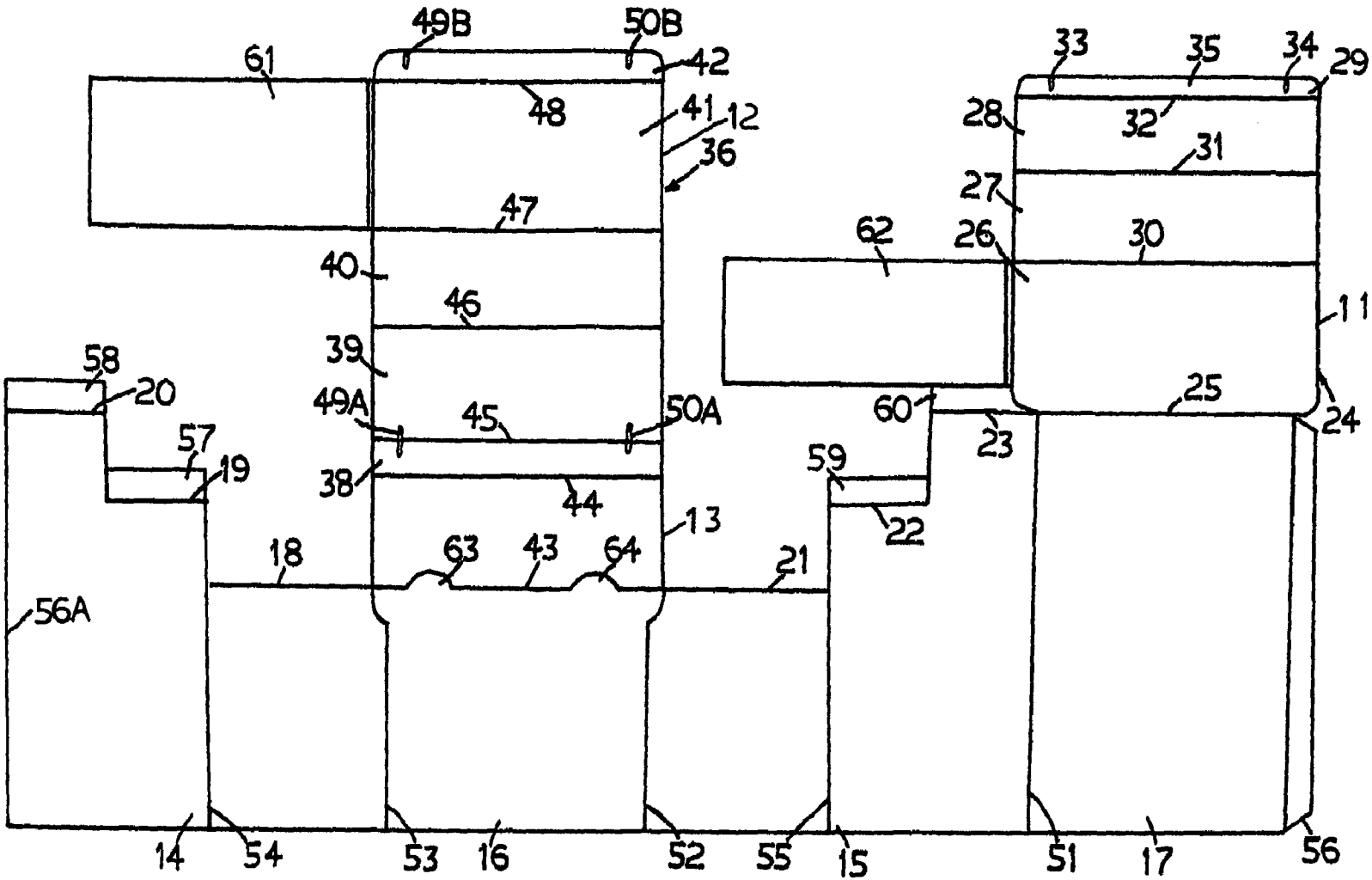
FIG. 2 is an elevation view of the single sheet material with the outline of the stepped display stand provided thereon.

The entire configuration as best shown in FIG. 2, consisting of the front panel, rear panel, side panels, and extension portions, may be formed on a single sheet material such as a cardboard. The rear panel 17 is joined with the right side panel 15 by vertical fold line 51. The right side panel 15 is joined with the front panel 16 by vertical fold line 52, and the front panel 16 is joined with the left side panel 14 by vertical fold line 53.

A vertical fold line 54 extends downwards from the front edge of the middle top edge 19 to the bottom of the side panel 14, and similarly a vertical fold line 55 extends downwards from the front edge of the middle top edge 22 to the bottom of the side panel 15.

A vertical mounting strip 56 is formed on the side of the rear panel 17.

Optionally, a foldable rectangular first reinforcing section 57 extends upwards from the middle top edge 19 of the left side panel 14, and a foldable rectangular second reinforcing section 58 extends upwards from the upper edge 20 of the left side panel 14. A foldable rectangular third reinforcing section 59 extends upwards from the middle edge 22 of the right side panel 15, and a foldable rectangular fourth reinforcing section 60 extends upwards from the upper edge 23 of the right side panel 15. A foldable rectangular reinforcing panel 61 extends sideways from the fifth section 41 of the upper extension portion 36 of the front panel 16, and similarly a foldable rectangular reinforcing panel 62 extends sideways from the first section 26 of the upper extension 24 of the rear panel 17.

Figure 3:
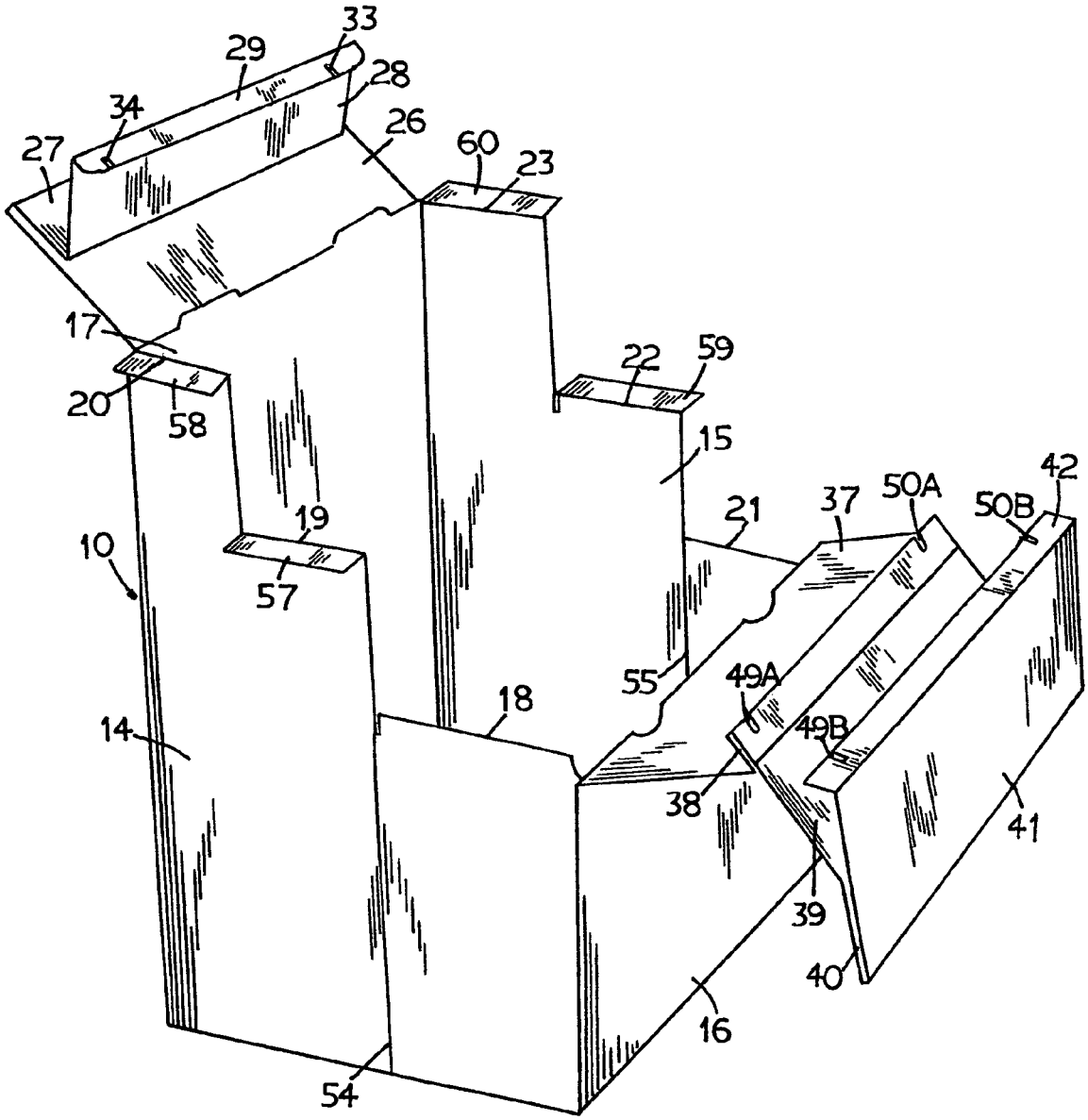
FIG. 3 is a perspective side elevation view of the stepped display stand in the partially assembled and opened condition.
Figure 4:
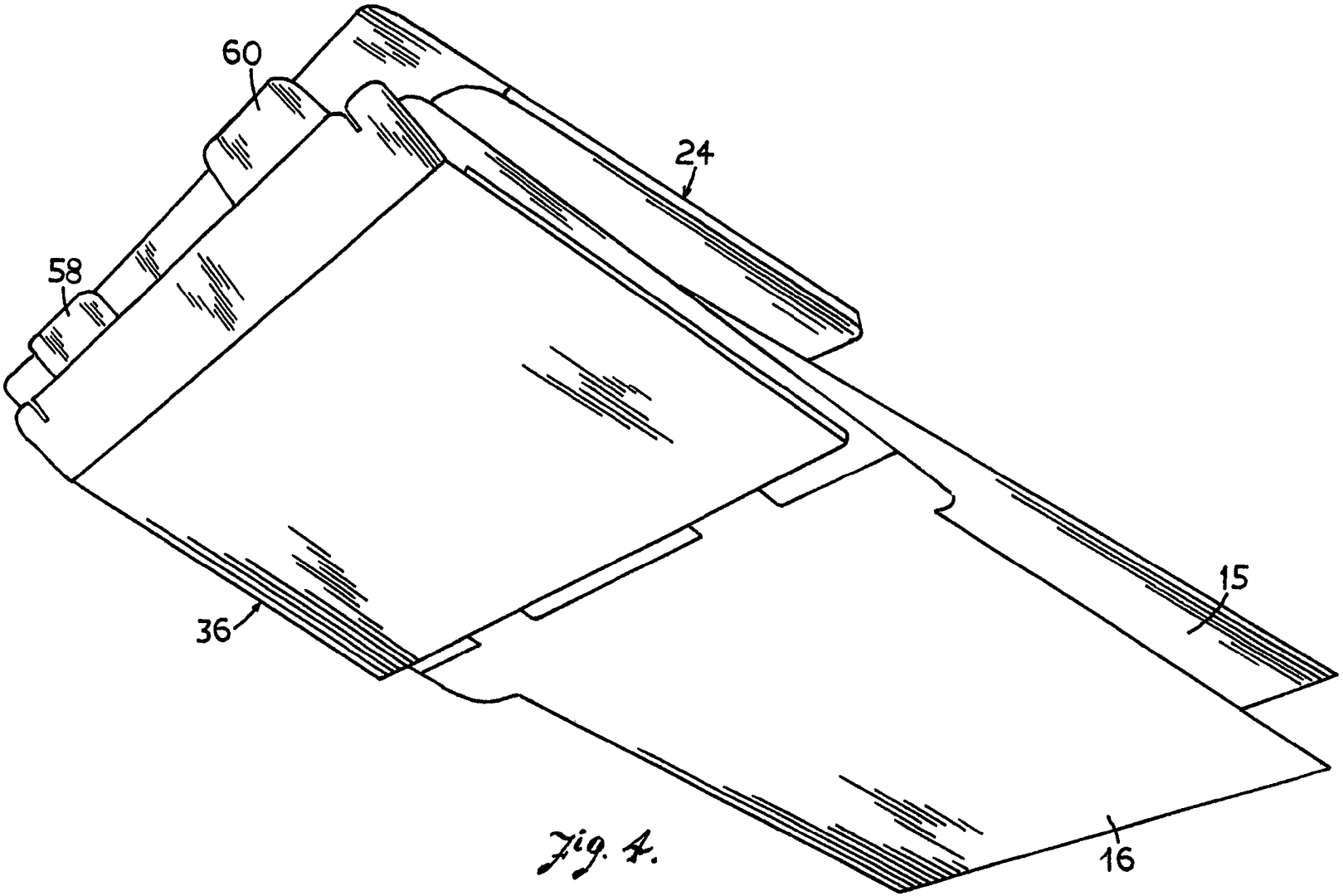
FIG. 4 is a perspective elevation of the stepped display stand in the collapsed folded condition for transportation and storage.

The display stand 10 may be partially assembled by folding the left side panel 14, the front panel 16, the right side panel 15, and the rear panel 17 along vertical fold lines 51, 52 and 53. The vertical mounting strip 56 is then secured to the vertical side edge 56A such as with adhesive. In this manner, the partially assembled stand as shown in FIG. 3 is formed. The partially assembled stand may be folded into a collapsed condition as shown in FIG. 4 by pushing the side panels 14 and 15 outwards such that they fold along the vertical fold lines 54 and 55. In this collapsed condition, the front panel 14 will abut the rear panel 17 to provide a flat assembly which is convenient for transportation and storage.

To set up the display stand 10 at the display location, the front panel 16 is pulled away from the rear panel 17 so as to form the rectangular basic support frame. The various sections of the upper extension portion 36 of the front panel 16 is then folded as best shown in FIG. 3 such that the slot openings 49A and 50A between the first section 37 and second section 38 become two open end slots. Upper extension portion 36 is flipped upwards until the third section 39 abuts the middle sections of both side panels 14 and 15; at this point, the first section 37 is pushed downwards to engage the open slots 49A and 50A with the lower top edges 18 and 21 of the side panels to latch the first section 37 securely in the horizontal position resting on the lower top edges 18 and 21 to form the lower shelf 13. The latching of the first section 37 to the side panels also strengthens the rectangular frame of the stand in a rigid secure manner. In the meantime, the third section 39 will abut vertically the side edges of the middle section of the side panels 14 and 15. The upper free end sixth section 42 will also abut the vertical side edges of the upper sections of the side panels 14 and 15. The fifth section 41 may then pushed downwards to engage the open slots 49 and 50 of the free end sixth section 42 with the side panels until the fifth section 41 is latched securely to the side panels and resting horizontally on the top edges 19 and 22 of the middle sections of the side panels to form the middle shelf 12.

After the shelves 12 and 13 have been formed, the various sections of the upper extension 24 of the rear panel 17 may be folded as best shown in FIG. 3, and then the first section 26 is flipped forward until it rests horizontally on the top edges 20 and 23 of the side panels 14 and 15 to form the upper shelf 11. The upper shelf 11 is latched securely in place by pushing the open slots 33 and 34 of the upper end section 29 to engage with the side edges of the top sections of the side panels such that the third section 28 will be latched securely in the vertical position abutting the side edges of the top sections of the side panels. The display stand 10 may be easily and quickly returned to the collapsed condition by reversing the order of the above steps.

The optional reinforcing sections 57, 58, 59, and 60 provide additional supports to the upper and middle shelves 11 and 12 as well as against any horizontal bending force exerted on the top edges 19, 20, 22 and 23 of the side panels 14 and 15. Also, the reinforcing panels 61 and 62 may be folded and secured such as by adhesive to the underside of sections 41 and 28 respectively to strengthen the upper and lower shelves 11 and 13.

Two spaced arcuate scored lines 63 and 64 may be formed on the horizontal fold line 43 such that two upstanding arcuate abutments 65 and 66 are formed at the front edge of the lower shelf 13 when the display stand 10 is in the set up condition. These abutments serve to prevent items on the lower shelf 13 from falling over the front edge therein.

Figure 5:
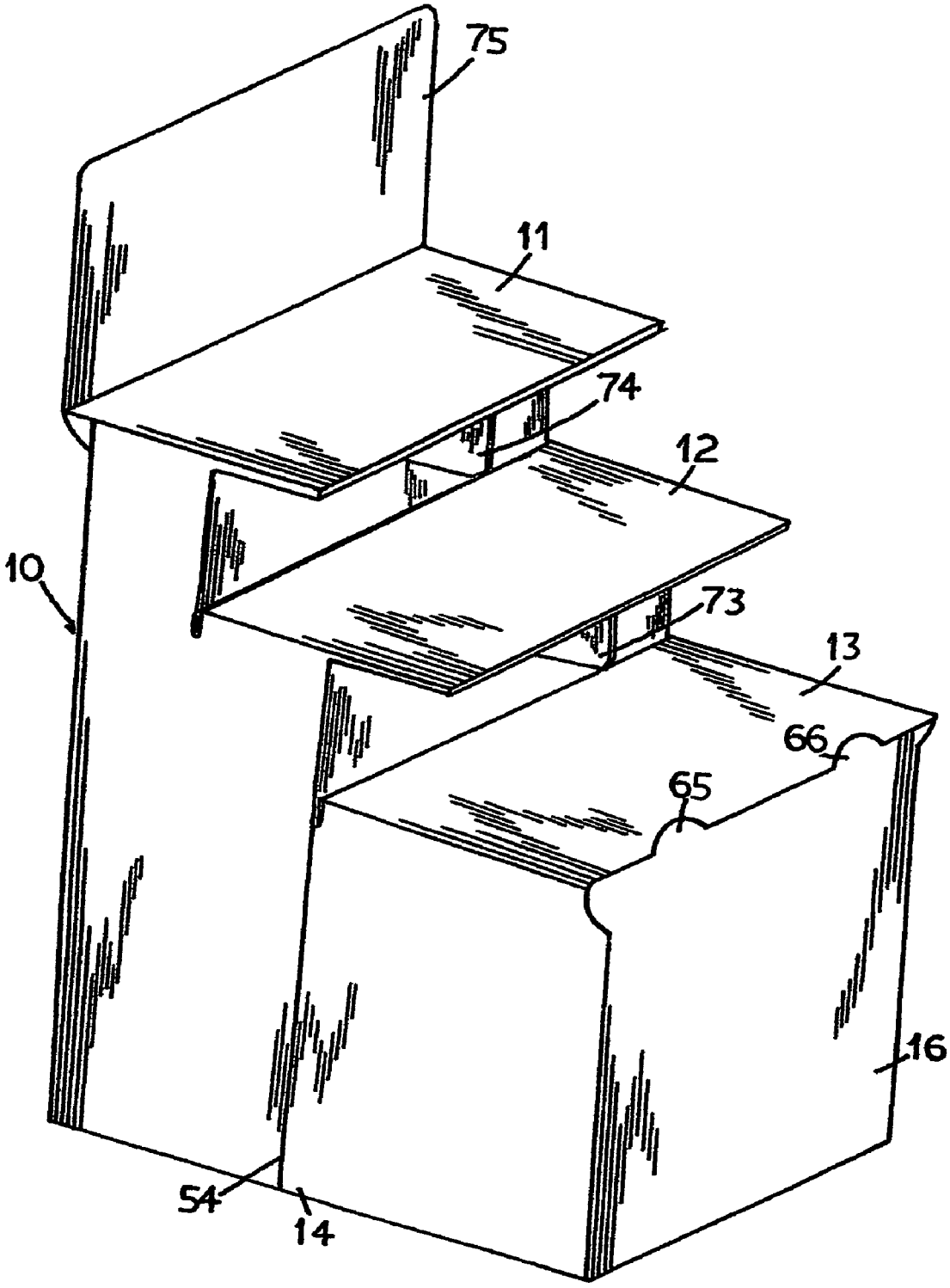
FIG. 5 is an alternative embodiment of the stepped display stand having reinforcing supports for the upper overhang shelves.
Figure 6:
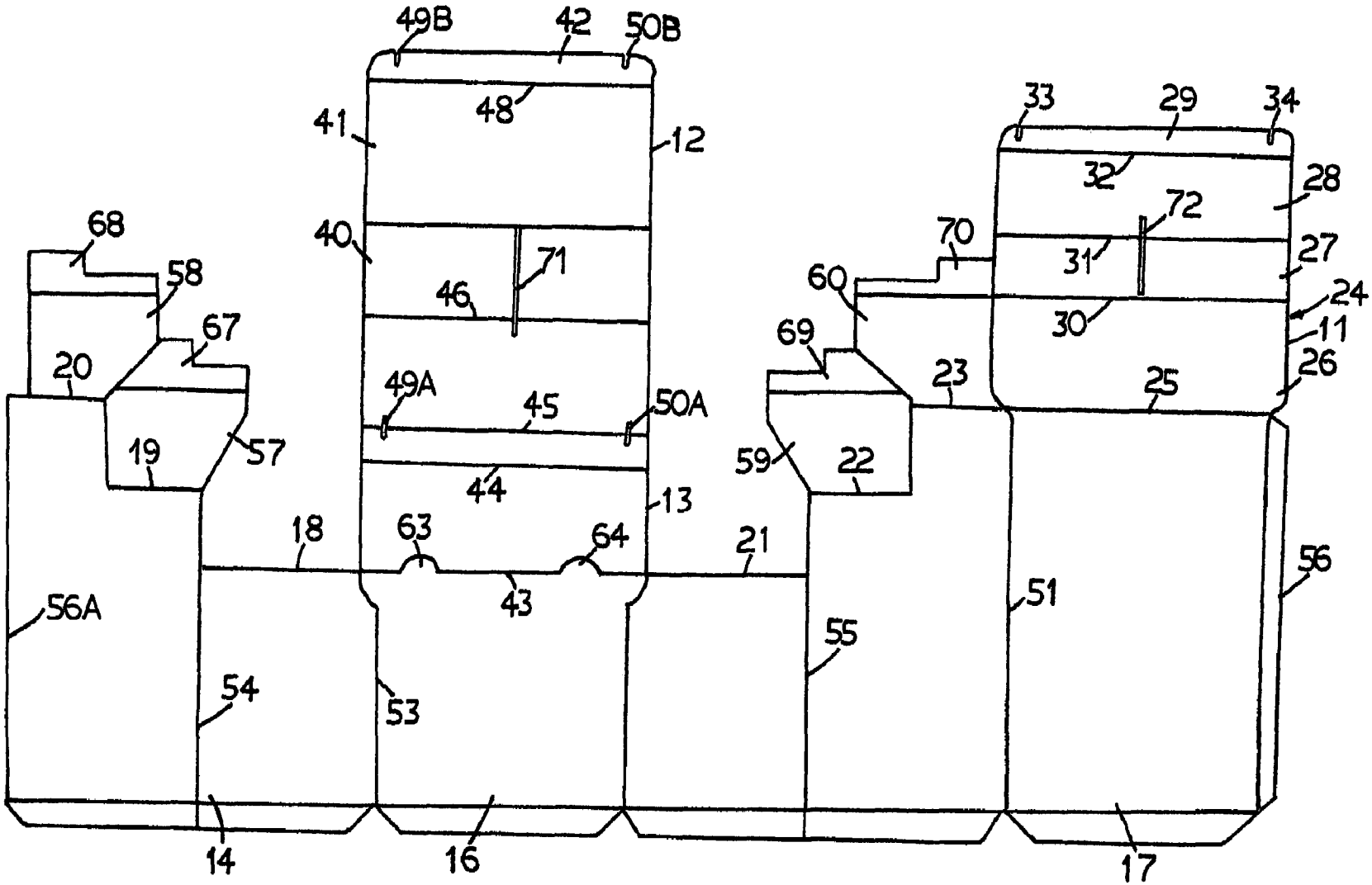
FIG. 6 is a perspective elevation of the outline of the alternative stepped display stand outline provided on a single sheet material.
Figure 7:
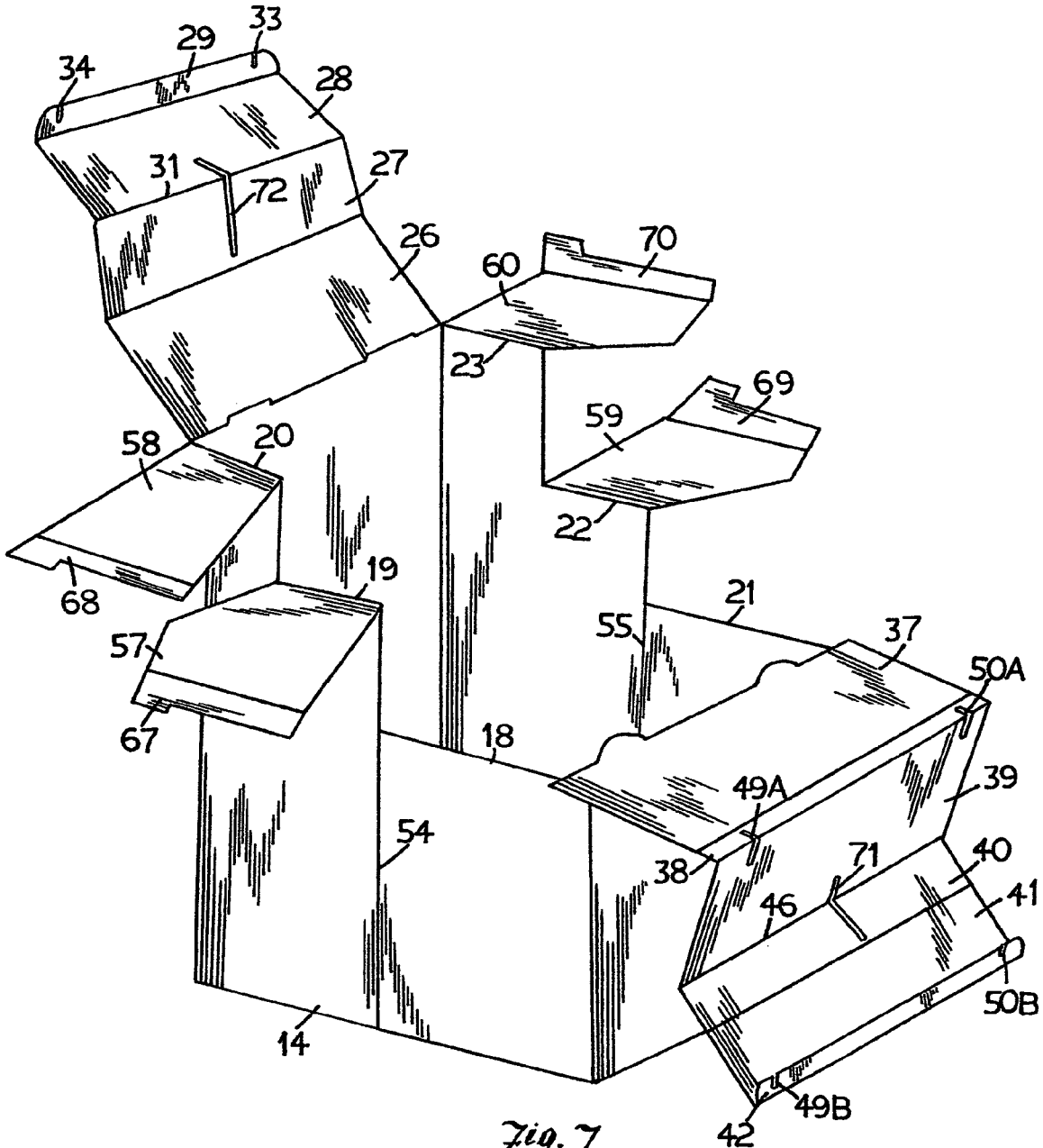
FIG. 7 is a perspective side elevation view of the alternative stepped display stand in the partially assembled and open condition.
Figure 8:
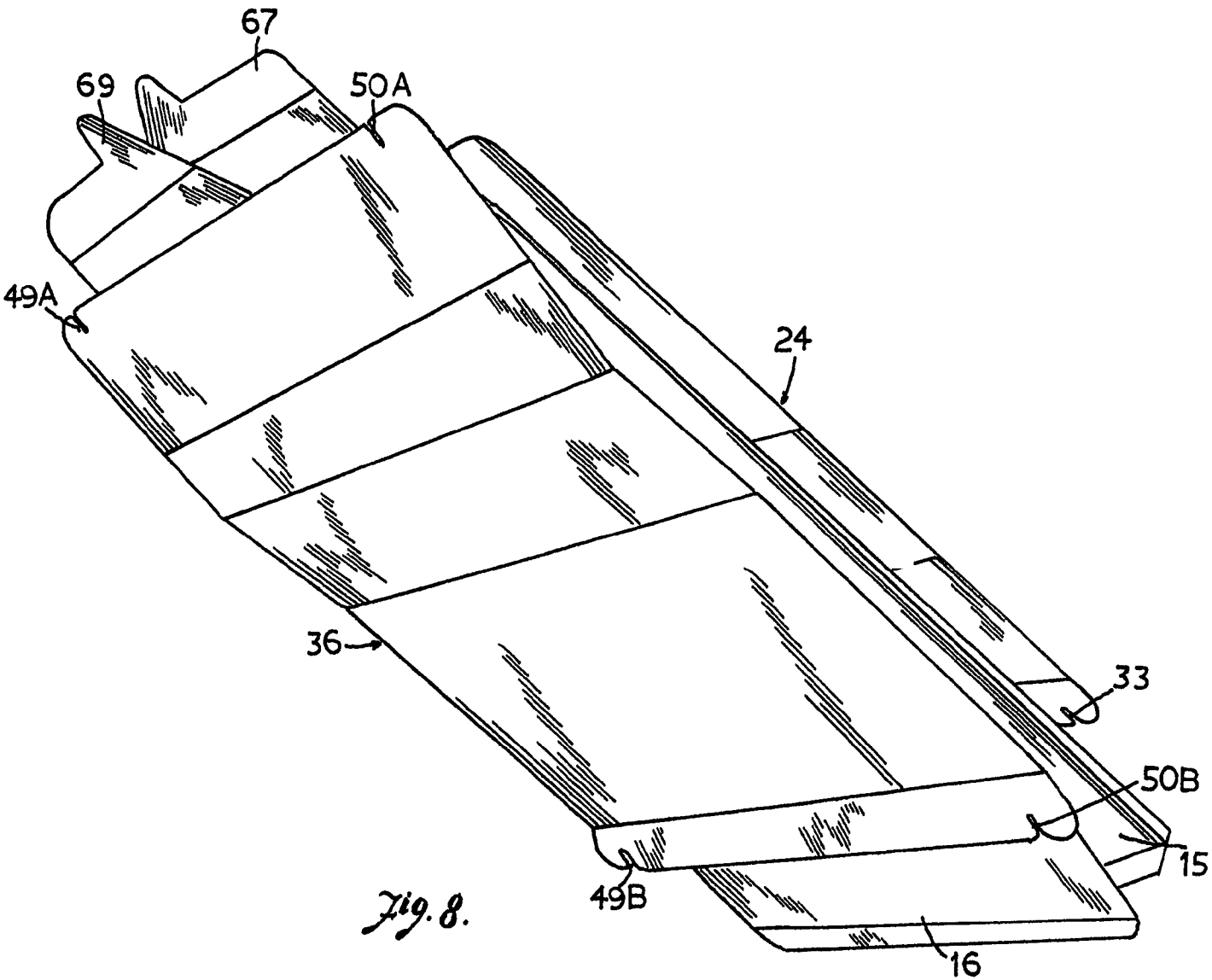
FIG. 8 is an perspective elevation view of the alternative stepped display stand in the collapsed folded condition for transportation and storage.

An alternative embodiment of the display stand of the present invention is shown in FIGS. 5 to 8. In these embodiment, the reinforcing sections 57, 58, 59, and 60 have a generally trapezoidal shape with foldable generally L-shaped outer extensions 67, 68, 69, and 70 as best shown in FIG. 7. Also, a vertical slot 71 is formed at the middle of the fold line 46 and extending into the sections 39 and 40 as shown, and a second vertical slot 72 is formed at the middle of the fold line 31 and extending into the sections 27 and 28 as shown. When the reinforcing sections 69 and 67 are folded towards the middle of the display stand they form horizontal supports 73 and 74 which engage with the slots 71 and 72 to lie underneath the upper and middle shelves 11 and 12 as best shown in FIG. 5.

A vertical display panel 75 may be mounted to the rear of the upper shelf 11 for displaying an artistic or descriptive advertisement of the articles placed on the display stand 10.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. A foldable display stand having three open sided shelves comprising, two side panels having a mirror image of one another and having three stepped upper edges located at different heights, a front panel, and a rear panel, said side panels, said front panel, and said rear panel being formed by a single geometrical figure formed on a single sheet material, and being foldable along adjoining vertical fold lines to form a substantially rectangular frame, said front panel having an upper extension section including six adjoining rectangular panels foldable along six horizontal fold lines to form a lower open shelf and a middle open shelf resting horizontally on predetermined opposite upper edges of said side panels, said rear panel having another upper extension section including three adjoining rectangular panels foldable along three horizontal fold lines to form an upper open shelf resting horizontally on additional predetermined upper edges of said side panels.

2. A foldable display stand according to claim 1 including two vertical fold lines formed in said side panels and located directly opposite to one another, and said rectangular frame being foldable into a collapsed condition relative to said vertical fold lines whereby said front panel and rear panel abut one another.

3. A foldable display stand according to claim 2 wherein said front panel includings an end panel having a free end with two spaced opened end slots formed therein, said opened end slots being operative for engaging with predetermined upper edges of said side panels for latching said middle open shelf securely in said horizontal position on said frame.

4. A foldable display stand according to claim 3 wherein said front panel includes a second panel and a third panel adjoined by a third horizontal fold line, and two spaced elongated slot openings formed at said third horizontal fold line, said elongated slot openings forming two opened end slots engageable with predetermined upper edges of said side panels when said second panel and third panel are folded relative to said third horizontal fold line.

5. A foldable display stand according to claim 4 wherein said rear panel includes an end panel having a free end edge, and two spaced slots formed in said free end edge and operative engageable with predetermined upper edges of said side panels for latching said upper shelf securely on said frame.

6. A foldable display stand according to claim 2 including a vertical mounting strip formed at a vertical free edge of said rear panel, said vertical mounting strip being attachable to a vertical free edge of one of said side panel to form said rectangular frame.

7. A foldable display stand according to claim 5 including reinforcing extension sections being foldable relative to said upper edges to provide reinforcing supports for said upper shelf and said middle open shelf.

8. A foldable display stand according to claim 7 including reinforcing panels adjoining to one side of a fifth panel of said upper extension section of said front panel, and to one side of a first panel of said another upper extension section of said rear panel, said reinforcing panels being attachable to underside of said upper shelf and said middle open shelf to provide reinforcement therefor.

9. A foldable display stand according to claim 8 including two spaced arcuate score lines formed at a horizontal fold line between said front panel and said upper extension section, said arcuate score lines forming two upstanding arcuate abutment at a front edge of said lower shelf when said upper extension section is folded relative to said front panel to form said lower shelf in a horizontal position.

10. A foldable display stand according to claim 7 including L-shaped outer extensions formed in said reinforcing extension sections and being foldable relative to said reinforcing extension sections to form supporting arms under said upper shelf and said middle open shelf.

* * * * *